US006719498B2

(12) United States Patent
Barley

(10) Patent No.: US 6,719,498 B2
(45) Date of Patent: Apr. 13, 2004

(54) SLOPE STABILIZER

(75) Inventor: Anthony Donald Barley, Harrogate (GB)

(73) Assignee: Keller Limited (GB)

( * ) Notice: Subject to any disclaimer, the term of this patent is extended or adjusted under 35 U.S.C. 154(b) by 0 days.

(21) Appl. No.: 10/148,661

(22) PCT Filed: Dec. 1, 2000

(86) PCT No.: PCT/GB00/04607

§ 371 (c)(1),
(2), (4) Date: Jul. 19, 2002

(87) PCT Pub. No.: WO01/40582

PCT Pub. Date: Jun. 7, 2001

(65) Prior Publication Data

US 2003/0099518 A1 May 29, 2003

(30) Foreign Application Priority Data

Dec. 3, 1999 (GB) ..... 9928711

(51) Int. Cl.[7] ..... E02D 5/80

(52) U.S. Cl. ..... 405/259.5; 405/259.1; 405/262; 405/302.4

(58) Field of Search ..... 405/259.1, 259.5, 405/259.6, 262, 284, 285, 286, 302.4

(56) References Cited

U.S. PATENT DOCUMENTS 4,069,677 A * 1/1978 Yamada et al. ..... 405/259.5
4,124,983 A * 11/1978 Weatherby ..... 405/259.5
4,386,876 A * 6/1983 Dupeuble ..... 405/259.5
4,630,971 A * 12/1986 Herbst et al. ..... 405/259.5
4,715,745 A 12/1987 Reichert
4,832,535 A 5/1989 Crambes
5,154,540 A * 10/1992 Barley ..... 405/259.5
5,395,185 A * 3/1995 Schnabel, Jr. ..... 405/262
5,582,492 A * 12/1996 Doyle, Jr. ..... 405/262

FOREIGN PATENT DOCUMENTS

| | | |
|---|---|---|
| CH | 670 271 | 5/1989 |
| EP | 0 807 717 | 11/1997 |
| GB | 2260999 | 5/1993 |
| WO | 99 06639 | 2/1999 |

* cited by examiner

*Primary Examiner*—Frederick L. Lagman
(74) *Attorney, Agent, or Firm*—MacMillian, Sobanski & Todd, LLC

(57) ABSTRACT

A slope stabilizer in which both a ground anchorage and a soil nail are located in a single borehole. The ground anchorage includes a plurality of ground anchorages, each including a tensile member bonded to the bore grout along substantially its whole length. The slope stabilizer has the advantage of allowing the ground to be pre-stressed using the ground anchorages. However, an active zone of the ground is also stabilized by the soil nail, which allows a lighter facing structure to be used than is normal with ground anchorages. Economy of operations is obtained, as a number of items are included in a single borehole.

7 Claims, 1 Drawing Sheet

SLOPE STABILIZER

The present invention relates to slope stabilising means.

There are two well known and much used systems for the stabilisation of vertical or steep faces cut in fresh ground by the utilisation of tensile members installed and bonded into the ground behind the faces.

A soil nail comprises a tensile member generally made of steel, other metal or a composite such as glass or carbon fibre reinforced plastic, installed into a pre-drilled borehole extending at a small angle below the horizontal into the ground and bonded to the ground over its entire length by use of a setting cement or resin grout.

Soil nails are installed as a group in relatively close proximity to each other, typically on a 1 m to 2.5 m square grid at the face of the excavation. The group of soil nails provides the in situ ground with a tensile strength and a shear strength not previously present in the ground.

When a face is cut or excavation is made, there is, without soil nails, a tendency for a zone of soil adjacent to the face to collapse into the excavation (the "active" zone). When soil nails are installed, the collapse of this active zone is prevented by the soil nails tying the active zone into the ground mass behind (the "resistant" zone). However, because the soil nails cannot be artificially pre-tensioned over their length during or immediately after installation, the utilisation of the tensile strength of the soil nail can only be made when the ground in the active zone moves forward in the relation to the ground in the resistant zone. Thus, the soil nails are known as "passive" reinforcement. Hence, forward movement of the active zone of the excavated face and downward movement of the face crest is always associated with the use of soil nails for face retention. In some instances, particularly with buildings or other sensitive structures in the vicinity, such movement is unacceptable.

The alternative system for stabilisation of vertical or steep faces cut in fresh ground is the use of ground anchorages but these must be used in conjunction with a stiff facial structure.

A ground anchorage comprises a tensile member or tendon made of steel, other metal or a composite such as glass or carbon fibre reinforced plastic, installed into a pre-drilled borehole extending at a small angle below the horizontal into the ground and bonded to the ground over only its distal length ("fixed length"), by use of setting cement or resin grout. The distal length over which ground bonding occurs is always sited in the resistant zone of the ground mass some distance from the excavated face. Throughout the active zone, the ground anchorage tendon is completely debonded from the ground by use of grease coating and plastic sheathing (the "free length" of the tendon). This isolates the tendons from the ground and from the grout which may also be placed in this length of the borehole.

However, since the tendon of a ground anchorage is not bonded to the ground within the active zone, it is necessary to provide a ground retaining structure in front of the active zone to which the head of the anchorage tendon is fixed. This structure or structural facing may be of steel (sheet piling, king piling etc.) or reinforced concrete (bored pile, diaphragm wall or structural facing built as excavation proceeds) for example.

At the head of the ground anchorage is an anchor head plate, which transfers load to the structural facing. The benefit of the ground anchorage system is that it allows the tensile member to be artificially pre-stressed prior to the excavation proceeding downward. A stressing jack is placed against the structure and a load is applied to the tendon. This exerts an inward directional force onto the structure and hence to ground behind. The entire tensile force applied to the tendon is transferred through the debonded length of the tendon in the active zone and resisted by the bond capacity of the ground in the resistant zone. Hence, the ground in the active zone is pre-compressed, thus movement of the face and the crest of the excavation is considerably less than that which would take place when utilising a soil nail system. However, the disadvantage of the ground anchorage solution is the high cost associated with the construction of the structural facing through which the entire stabilising load must be transferred.

A description of the use and construction of ground anchorages is to be found in the Code of Practice for Ground Anchorages—BS8081—published by the British Standards institution. This Code also contains suggested terminology.

GB 2223518 describes a single bore multiple anchorage comprising a plurality of unit anchorages, each having a tendon, the tendons being bonded in respective encapsulations at staggered and spaced positions along the bore.

Methods have been utilised in the past for stabilisation of vertical or steep faces cut in fresh ground in which a combination of soil nails and ground anchorages have been considered beneficial.

The present invention provides slope stabilising means comprising a bore containing bore grout and:

(i) at least one ground anchorage means, comprising a tendon having a bond length which is bonded along the bond length within the bore grout and a free length arranged so that there is substantially no adhesion between the free length and the bore grout; and (ii) at least one soil nail means comprising a tensile member bonded to the bore grout along substantially the whole length of the tensile member.

The present invention has the benefit of directly tying the ground in the active zone to the ground in the resistant zone using the soil nail, at the same time as pre-compressing the active zone ground using the ground anchorage, thus reducing or eliminating face and crest movement. The benefits of both slope stabilising systems can be obtained combined.

The present invention has the additional advantage that, by placing a soil nail and a ground anchorage in a single bore hole, the number of bore holes and components required can be reduced.

The inventors have discovered that, surprisingly, the inclusion of a soil nail in the bore grout of a ground anchorage does not detract from the performance of the ground anchorage. Indeed, by tying the area of ground in the region of the end of the tendon, the soil nail helps to resist the compressive load at the proximal end, allowing a lighter structural facing to be used. Finally, it is found that the inclusion of a ground anchorage does not interfere with the operation of the soil nail.

The present invention further provides a method of stabilising slopes, comprising forming a bore in the ground, and placing in the bore:

(i) at least one ground anchorage means comprising a tendon having a bond length and a free length, and (ii) at least one soil nail means comprising a tensile member;

grout being fed into the bore whereby the bond length of the tendon of the ground anchorage means is bonded to the grout, the free length of the tendon being arranged to have substantially no adhesion to the resulting grout within the bore, and whereby the tensile member of the soil nail means is bonded to the bore grout along substantially the whole length of the tensile member;

an anchor head being fitted onto the tendon of the ground anchorage means; and the tendon being stressed and locked with respect to the anchor head.

The Ground Anchorage Means

In a preferred embodiment, there are a plurality of unit anchorages received in a single bore. The bond lengths of tendons of respective unit anchorages are preferably anchored in the bore grout in staggered and spaced relationship along the bore.

The tendons of the ground anchorages may comprise steel, other metal or synthetic polymeric material, for example composite material such as glass or carbon fibre reinforced plastic.

Where steel or other corrodable materials are used, the bond length of the tendon is bonded in an encapsulation comprising a duct filled with resin or cement grout. This encapsulation is bonded in the bore grout whereby the bond length is bonded to the bore grout. Polymeric components surrounding the free length will also be required to resist corrosion.

However, when any tendon is made of carbon or glass reinforced plastic or other non-metallic material, corrosion protection is not required for that tendon.

Preferably, all of the tendons comprise synthetic polymeric material.

The bond length of a unit anchorage within the bore will be selected depending upon the ground strength, the soil grading and the bond capacity of the grout with the soil/ground at the respective depth.

Ground anchorages comprising tendons of synthetic polymeric material are described in our co-pending United Kingdom patent application no. 9817186.1.

The tendon may comprise a length of polymeric fibre, such as nylon of a suitable grade. Most preferably, the tendon comprises a composite comprising synthetic polymeric material. For example, it may comprise nylon or kevlar strands embedded in a synthetic resin. Alternatively, it may comprise glass reinforced plastic, or carbon fibre reinforced plastic.

The tendon may be of any suitable shape or any suitable dimensions. The tendon is suitably approximately circular in cross section, preferably having a diameter in the range 10–50 mm. Alternatively, flat cross sections, such as rectangular or elliptical cross sections may be used. Such flat cross sections may have a thickness (minor axis) in the range 3–15 mm and a width (major axis) in the range 20–100 mm. The modulus of the elasticity of the tendon is preferably in the range 50–200 kN/m$^2$. Commonly available tendon materials have moduli of elasticity in the range 50–100 kN/m$^2$.

The strength of the tendon should be high as possible. Preferably, the capacity is at least 50 kN. Typical glass reinforced plastic tendons have a capacity in the range of 50–500 kN. Carbon fibre tendons may have a capacity in the range 2000–3000 kN.

A tendon for use in the present invention may typically comprise a plurality of fibres aligned with the length of the tendon, the fibres being retained in a resin medium. Such tendons are suitably manufactured by a pultrusion process, as is well known to the person skilled in the art. The tendons may be solid or hollow. Hollow tendons may have a central space whose dimensions are in the range 10–30% of the corresponding outside dimensions of the tendon. For example, a 22 mm diameter tendon may have a central hole of diameter 5 mm.

The bond length of each of the tendons is fully or partially bonded directly to the selected length of the bore grout and no additional stop member or encapsulation is required.

Preferably, the bonding between the bond length and the bore grout is the sole anchoring effect within the bore grout and operates in the absence of any transverse mechanical stop member within the bore grout.

The free length is preferably suitably treated to ensure that there is little or substantially no adhesion between the free length and the bore grout. For example, it may be lubricated, for example greased. It may additionally or alternatively be sheathed with plastic material to prevent adhesion to the bore grout.

Portions of tendons adjacent and parallel to bond lengths of adjacent tendons (where present) may be surrounded with compression-resistant ducting, for example a tube of rigid material that is strong in a direction transverse to its length.

The force exerted on the grout by the bonding of the tendon acts in a direction to burst the surrounding grout. If the bond length lies in the vicinity of one or more free lengths of adjacent tendons, there may be a problem. Free lengths of tendons are greased for movement and are not bonded to the bore grout. They accordingly represent regions of weakness in the resisting of the bursting force. This weakness is made worse, if, as is typically the case, the free lengths of tendons are individually sheathed with one or more layers of synthetic polymeric material covering at least those portions of the tendon near the respective bond length of another tendon. Suitable compression resistant ducting may comprise compression resistant polymeric material or the like.

A similar arrangement is shown in GB 2260999 in relation to a single bore multiple anchorage in which a plurality of metal tendons are held within encapsulations at staggered and spaced positions along the bore.

To increase the bond of the tendon within the grout, the bond length of the tendon is preferably deformed on its outer surface within the grout. The surface of the tendon may have a wave shaped profile.

The ground anchorage means will include an anchor head at the open end of the bore.

Where a plurality of ground anchorages are present, each separate tendon may be provided with a respective stressing jack for extending and placing the tendon under load. Each respective stressing jack will extend by a different amount to the other jacks, depending upon the corresponding elastic length of the tendon in the bore. The tendons may be simultaneously loaded to the same load or they may be loaded to different predetermined load.

The Soil Nail Means

The tensile member of the soil nail means preferably comprises steel, other metal or it may comprise a synthetic polymeric material. Any polymeric material described above in respect of the ground anchorage will be suitable for use as a tensile member in the soil nail means.

There may be a plurality of soil nail means in the bore.

In order to increase the bond between the soil nail means and the grout, the tensile member may be deformed on its surface.

If the tensile member is made of steel or other corrodable material, plastic components surrounding the tensile member may be required to ensure protection against corrosion. The plastic component may comprise a corrugated plastic duct surrounding the tensile member.

Special Features of Combined Soil Nail Means and Ground Anchorage Means

Including both a soil nail means and a ground anchorage means in a single bore may require certain particular modifications.

It is required that both the soil nail means and the ground anchorage means should be bonded to the resistant zone of the ground.

The bond length of the soil nail may be located in the bore grout in staggered and spaced relationship with the bond length or bond lengths of ground anchorage means present in the bore. This is to avoid the application of high local bond stress.

The free length of the ground anchorage means may extend over the bond length of the soil nail means in just the active zone or over the full bond length of the soil nail.

Preferably, the bond length of the ground anchorage means is located in the bore at a depth greater than the bond length of the soil nail means.

Where a plurality of unit ground anchorages are present, the first unit anchorage may be fixed to the ground alongside or beyond the bond length of the soil nail, the second unit anchorage may be bonded to the ground beyond the bond length of the soil nail and the first unit anchorage and the third unit anchorage bonded to the ground beyond the second unit anchor and so on.

As discussed above, the ground anchorage means will include an anchor head at the open end of the bore. A facing structure may be provided against the face of the ground for retaining the ground. The anchor head serves to transfer the compressive load from the ground anchorage through the facing structure to the slope face on the outside of the active zone. However, it has been found that the anchor head may be of smaller size and stiffness compared to those used with systems that employ ground anchorages alone. This is due to the fact that the active zone of ground in the region of the anchor head is retained by both the direct bonding of the soil nail means into the mass of the active zone and by the pre-stressed ground anchorage retaining the active ground zone at the face. It is preferred that the tensile member of the soil nail means extends to a region adjacent to the anchor head.

General Features

The bore extends into the ground behind the slope in the normal manner, preferably at an angle below the horizontal.

In the method of the invention, grout may be fed into the bore before, after or even during insertion of the ground anchorage means and said nail means into the bore.

The slope stabilising means of the present invention may be applied to vertical faces, to steep faces or for the improved stabilisation of relatively shallow slopes where the application of pre-stressed, reduced or constricted movement is also beneficial.

The present invention will now be described by way of example only with reference to the accompanying drawings, in which:

BRIEF DESCRIPTION OF THE DRAWINGS

In FIG. 1, a cut face or slope (1) of an area of ground is to be stabilised. The dotted line divides the unstable or active zone (2) from the stable or resistant zone ground (3).

Figure 1:
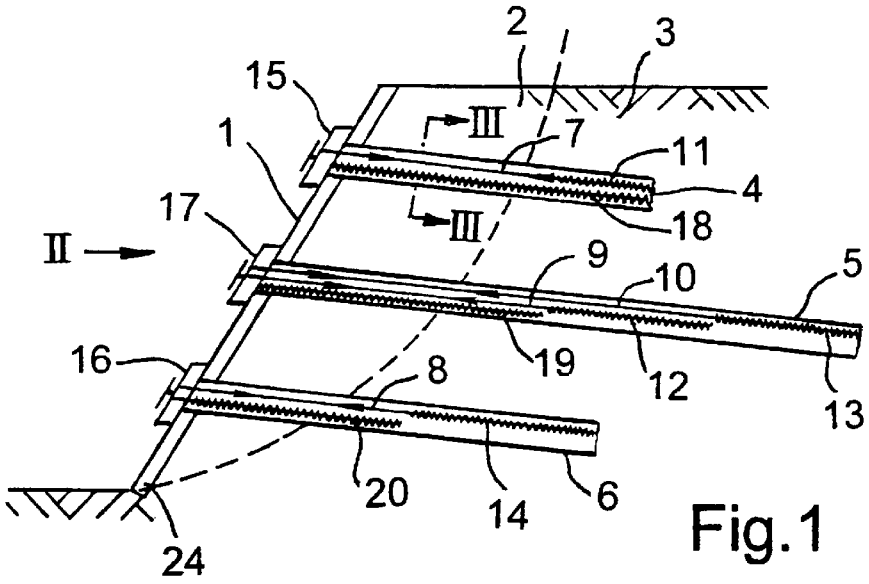
FIG. 1 is a schematic view in a vertical plane of a slope stabilised using slope stabilising means according to the present invention.

There are shown three boreholes (4), (5) and (6) each extending from the cut face (1), through the active zone (2) to the resistance zone (3).

Each borehole (4), (5) and (6) comprises ground anchorage means. Borehole (4) and (6) each include a single ground anchorage (7) and (8) respectively. Borehole (5) comprises two separate unit anchorages (9) and (10) received in the same borehole. Each unit anchor (7), (8), (9) and (10) includes a bond length (11), (12), (13) and (14) bonded to the grout in the area of the resistant zone (3). In borehole (5), the bond lengths (12) and (13) are located in staggered, spaced relationship to prevent any part of the bore grout being subjected to excessive load.

Each unit anchorage (7), (8), (9) and (10) comprises a free length which forms substantially no bond to the bore grout. This may be achieved by means (not shown) such as grease or sheathing or both. Once a bond has been formed between the ground anchorage (7), (8), (9) and (10) and the bore grout, the tendon is put into tension by jack means (not shown) and locked against an anchor head (15), (16) and (17) respectively. In ground anchorage (5), the unit anchors (9) and (10) are separately stressed and locked off against anchor head (17), in a manner known in the art.

Each borehole (4), (5) and (6) also comprises a soil nail (18), (19) and (20) respectively. In each case, the soil nail comprises a tensile member bonded over substantially its whole length to the bore grout. In each case, the tensile member extends through the active zone and into the resistant zone (3).

In borehole (4), the bond length of the unit anchorage (7) overlaps the bond length of the soil nail (18). However, in boreholes (5) and (6), the bond lengths in the resistant zone of the tensile members (19) and (20) respectively are located in staggered space relationship with the bond lengths of the respective unit anchors (12), (13) and (14).

A facing structure 24 is shown. The anchor heads 15, 16 and 17 transfer load through the facing structure 24 to the active zone of ground 2.

Figure 2:
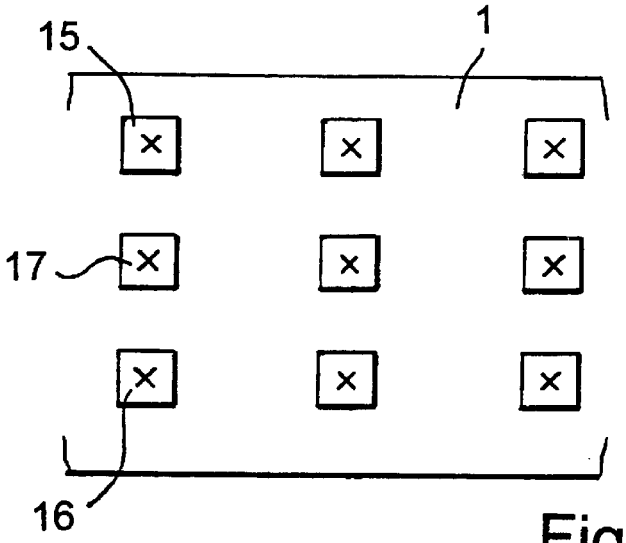
FIG. 2 is a schematic view in the direction of arrow II in FIG. 1 of the stabilised ground.

FIG. 2 shows a schematic view in the direction of arrow II of the cut face (1) showing a grid pattern of anchor heads including anchor heads (15), (16) and (17). The array is similar to the array typically used for ground anchorages and/or soil nails in a manner known in the art.

Figure 3:
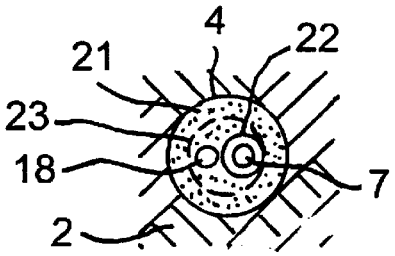
FIG. 3 is a section along line III—III in FIG. 1.

FIG. 3 is a schematic cross section along line III/III of borehole (4). The section is located in the active zone (2). Inside the bore (4) there can be seen the bore grout (21), the tensile member (18) of the soil nail means and the tendon (7) of the ground anchorage means.

The tensile member (18) of the soil nail means is bonded to the bore grout (21) in this zone.

The tendon (7) of the ground anchorage is, however, not bonded to the bore grout (21). It is sheathed in a material (22) to prevent adhesion between the tendon (7) and the bore grout (21). Finally, corrosion resistant means in the form of a corrugated plastic duct surrounds both the tensile member (18) of the soil nail means and the tendon (7) of the ground anchorage, to prevent corrosion.

The invention has been described above by way of example only and modifications can be made within the invention. The invention also consists in any individual features described or implicit herein or shown or implicit in the drawings or in any combination of such features or any generalisation of any such features or combination.

What is claimed is:

1. Slope stabilizing means comprising a bore in the ground containing bore grout and:

(i) at least one ground anchorage, said ground anchorage including a plurality of unit anchorages received in the bore, each unit anchorage including a tendon having a bond length which is bonded along the bond length within the bore grout and a free length arranged so that there is substantially no adhesion between said free length and the bore grout, the bond lengths of tendons of respective unit anchorages being anchored in the bore grout in staggered and spaced relationship along the bore; and (ii) at least one soil nail including a tensile member bonded to the bore grout along substantially the whole length of said tensile member.

2. Slope stabilizing means according to claim 1, wherein at least one tendon of said ground anchorage or at least one tensile member of said soil nail or both comprises synthetic polymeric material.

3. Slope stabilizing means according to claim 1, wherein the free lengths of the tendons of said ground anchorage are suitably treated to ensure that there is little or no adhesion between the free length and the bore grout.

4. Slope stabilizing means according to claim 1, wherein the bond length of the tendons of said ground anchorage are deformed on an outer surface within the grout.

5. Slope stabilizing means according to claim 1, wherein said tensile member of said soil nail is deformed on its surface.

6. Slope stabilizing means according to claim 1, and further including an anchor head at an open end of the bore, and wherein said tensile member of said soil nail extends to a region adjacent to said anchor head.

7. A method of stabilizing a slope, comprising forming a bore in the ground and placing in the bore:

(i) at least one ground anchorage, said ground anchorage including a plurality of unit anchorages, each unit anchorage including a tendon having a bond length and a free length, the bond lengths of tendons of respective unit anchorages being placed in the bore in staggered and spaced relationship along the bore, and (ii) at least one soil nail including a tensile member;

feeding grout into the bore whereby the bond lengths of the tendons of the ground anchorage are bonded to the grout, the free length of each tendon being arranged to have substantially no adhesion to the resulting grout within the bore, and wherein said tensile member of said soil nail is bonded to the bore grout along substantially the whole length of said tensile member;

wherein an anchor head is fitted onto said tendons of the ground anchorage; and wherein each tendon is stressed and locked off individually with respect to said anchor head.

* * * * *